US007918075B2

(12) United States Patent
James

(10) Patent No.: US 7,918,075 B2
(45) Date of Patent: Apr. 5, 2011

(54) ROTATABLE STIRRUP BAR FOR A SADDLETREE

(75) Inventor: Trevor Graham James, Kallangur (AU)

(73) Assignees: Trevor Graham James, Queensland (AU); Beverly Joan James, Queensland (AU)

( * ) Notice: Subject to any disclaimer, the term of this patent is extended or adjusted under 35 U.S.C. 154(b) by 0 days.

(21) Appl. No.: 12/232,736

(22) Filed: Sep. 23, 2008

(65) Prior Publication Data

US 2009/0044498 A1 Feb. 19, 2009

Related U.S. Application Data

(62) Division of application No. 10/485,101, filed as application No. PCT/AU02/01023 on Aug. 1, 2002, now Pat. No. 7,472,530.

(51) Int. Cl.
*B68C 1/16* (2006.01)

(52) U.S. Cl. ..... 54/46.2; 54/46.1

(58) Field of Classification Search ..... 54/46.1, 54/46.2

See application file for complete search history.

(56) References Cited

U.S. PATENT DOCUMENTS

| | | | | | |
|---|---|---|---|---|---|
| 58,121 | A | * | 9/1866 | Meyer | 54/46.1 |
| 474,715 | A | * | 5/1892 | Bailey | 54/46.1 |
| 918,212 | A | * | 4/1909 | Solatinow | 54/46.1 |
| 2,091,897 | A | * | 8/1937 | Vance | 54/46.1 |

* cited by examiner

*Primary Examiner* — Rob Swiatek
(74) *Attorney, Agent, or Firm* — Stein McEwen, LLP

(57) ABSTRACT

A horse saddle has a saddletree to which is mounted a rotatable stirrup bar secured to a pivot which is transverse to the length of the saddletree. The rotatable stirrup bar allows the stirrup leathers to rotate both forwardly and rearwardly of the pivot, relative to the saddle, with reduced wear and tear to the stirrup leather. The stirrup bar comprises a closed loop for retaining the stirrup loop on the stirrup bar during rotation.

8 Claims, 4 Drawing Sheets

ROTATABLE STIRRUP BAR FOR A SADDLETREE

CROSS-REFERENCE TO RELATED APPLICATION(S)

The present divisional application is based upon U.S. patent application Ser. No. 10/485,101, filed Jul. 28, 2004, and now U.S. Pat. No. 7,472,530, which is a 371 of PCT/AU02/01023, filed Aug. 1, 2002.

FIELD OF THE INVENTION

This invention is directed to horse saddles and is particularly directed to a stirrup bar that can be pivotally or rotatably attached relative to the saddletree. The stirrup bar comprises a closed loop for retaining a stirrup loop on the stirrup bar during rotation. The invention will be described with reference to a horse saddle but it should be appreciated that the invention may also extend to saddles for other types of animals.

BACKGROUND OF THE INVENTION

A saddle is typically manufactured using a rigid internal saddle frame, which is also known as a saddletree. A typical saddletree is illustrated in FIG. 1. The saddletree is made of rigid material that may comprise wood, laminated wood, fibreglass, rigid plastics material and the like. The saddletree typically has a length of between 50-90 cm and a width of between 30-60 cm although this can vary. The tree has a rear cantle portion (see reference numeral 11 FIG. 1), a front gullet portion (reference numeral 12 FIG. 1) and a pair of side rails (13, 14 FIG. 1). A strong steel stirrup bar (15) is fixed to the front portion of the saddletree and is immovable with respect to the saddletree. The stirrup bar illustrated in FIG. 1 is typical for an Australian saddle, and the stirrup bar is made such that the stirrup leather can be releasably attached to the stirrup bar. For an American western saddle, the stirrup bar is in the form of a closed loop, which means that the stirrup leather cannot be released from the stirrup bar.

In use, a stirrup is attached to each stirrup bar. The stirrups function to hold and support a rider's foot. If the rider stands-up the entire weight of the stirrups, and therefore the stirrup bar supports the rider. This creates quite large stresses on the stirrup leather that are transferred to the stirrup bar. If the direction of the stress is at an angle to the stirrup bar, there is a possibility of damage to the stirrup bar, and/or damage to the saddletree.

Stirrup bars are known that allow the stirrup to swing inwardly and outwardly relative to the saddle. Sometimes a loose fit of the stirrup leather to the bar is sufficient; other times the stirrup bar can contain a bush or sleeve to allow the leather to swing inwardly and outwardly relative to the saddle. It is also known to provide some lateral adjustment of the stirrup leather relative to the bar (i.e. allowing the leather to be spaced further away or nearer to the rider's legs).

The present invention is directed to a stirrup bar assembly that has a member which can rotate and which can reduce stress on the leather strap that is attached to the stirrup bar. In one form, this can be achieved by having the stirrup leather attached to the member which can rotate about an axis which is transverse to the length of the saddle to reduce stress on the stirrup leather, and/or the stirrup bar and therefore to the saddle tree.

It is an object of the invention to provide a stirrup bar assembly, and a saddle having such a stirrup bar assembly that may overcome at least some of the abovementioned disadvantages or provide the public with the useful or commercial choice.

In one form, the invention resides in a stirrup bar assembly, the assembly comprising a stirrup bar that is mounted for rotation relative to a saddletree.

Suitably, the stirrup bar assembly comprises an attachment plate. The attachment plate is typically attached to the saddletree. The means of attachment may vary but may include fasteners, adhesive, or manufacture of the saddletree in such a manner that the attachment plate forms part of the saddletree. The attachment plate may comprise a metal plate. The metal plate may comprise steel. The metal plate may be substantially planar. The metal plate may have a length of between 5-20 cm, a width of between 3-10 cm, and a thickness of between 1-5 mm. This can of course vary to suit. The metal plate may be substantially rectangular when viewed in plan but may have beveled corners.

A shaft may be attached to the attachment plate. The shaft may extend from one side of the attachment plate and is typically substantially perpendicular to the attachment plate. The shaft may comprise a cylindrical shaft. The shaft may be manufactured from metal such as steel. One end of the shaft may be fixed to the attachment plate such that the shaft does not rotate relative to the attachment plate. Alternatively, the shaft may be fitted such that it can rotate relative to the attachment plate. The shaft may have a length of between 10-40 mm, and if the shaft is cylindrical, it may have a diameter of between 10-30 mm.

Alternatively, the stirrup bar assembly may comprise a shaft that is provided with a laterally extending portion such as a flange. In this arrangement, the attachment plate need not be present. The saddletree side plate can be formed with an opening through which the shaft passes with the laterally extending portion preventing the shaft from passing entirely through the opening. The laterally extending portion can then be fixed to the saddletree to hold the shaft in place.

If desired, a plurality of openings may be formed through the saddletree side plate to allow the shaft to be mounted relative to the saddletree at different positions to improve the comfort position for a rider.

A bearing may be attached relative to the shaft. The bearing may comprise a roller bearing that may be pressed over the shaft. One or more thrust washes may be provided which may be on each side of the bearing.

The stirrup bar may be attached to the roller bearing. Suitably, the stirrup bar is fixed to the roller bearing such that rotation of the bearing causes rotation of the stirrup bar. The stirrup bar is suitably able to rotate 360° relative to the attachment plate.

Alternative arrangements are envisaged to allow the stirrup bar to be rotatably mounted relative to the saddletree. For instance, the shaft may be rotatably mounted relative to the attachment plate, and the stirrup bar may be mounted to the shaft.

The stirrup bar typically comprises a metal member. The metal member may be formed from metal plate. The metal member may be provided with a supporting finger on which the stirrup leather can be attached in a removable manner. In this arrangement, the supporting finger may have a free end to allow the stirrup leather to be attached and removed relative to the supporting finger.

Alternatively, the stirrup bar may be shaped or configured such that the stirrup leather cannot be removed. For instance, the stirrup bar may be in the form of a closed loop. The closed loop may have a substantially triangular shape to define an internal opening or eyelet through which the stirrup leather can extend.

Alternative configurations of the stirrup bar are envisaged.

A stop means or limit means may be provided to prevent undesirable rotation of the stirrup bar. This may be in the form of a projection, button, profile and the like. The stop means or limit means may be attached to the saddletree. The stirrup bar may be provided with an abutment portion that can abut with the stop means or limit means to prevent further undesirable rotation of the stirrup bar.

BRIEF SUMMARY OF THE INVENTION

The instant invention is directed to a stirrup bar assembly comprising a stirrup bar for mounting a stirrup loop, the stirrup bearing mounted relative to a saddletree for rotation about a pivot which is transverse to the length of the saddletree with the stirrup bar hanging below the pivot. The mounted stirrup is able to rotate forwardly, and rearwardly of the pivot while the stirrup loop is mounted to the stirrup bar. The stirrup bar comprises a closed loop, preferably of triangular shape, for retaining the stirrup loop on the stirrup bar during rotation. The stirrup bar assembly is attached to the saddletree by an axle or an attachment plate, and a stop member is provided to prevent over-rotation of the stirrup bar.

BRIEF DESCRIPTION OF THE DRAWINGS

Embodiments of the invention will be described with reference to the following drawings in which.

DETAILED DESCRIPTION

Figure 1:
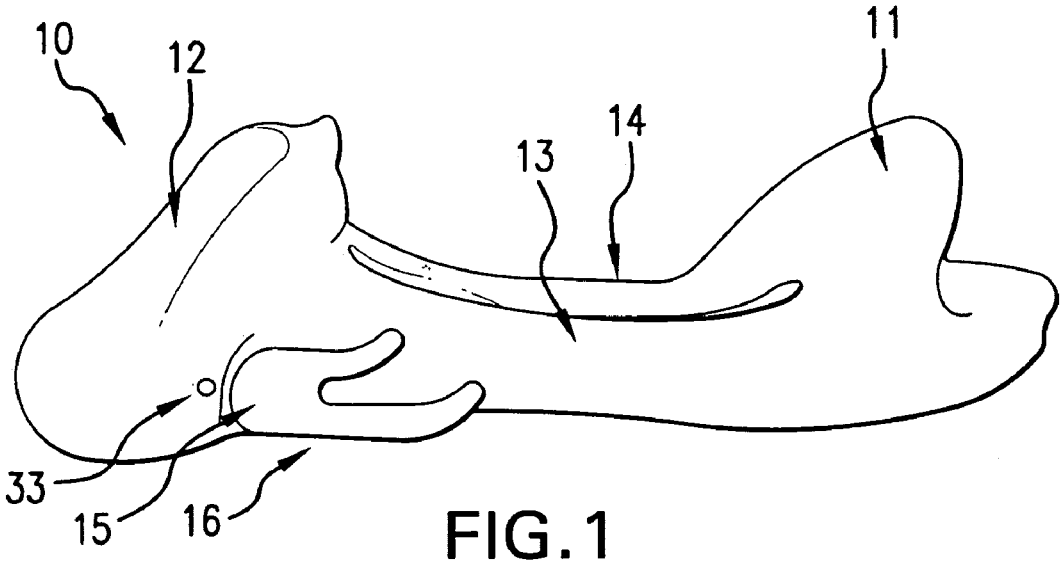
FIG. 1 PRIOR ART
FIG. 1 illustrates a known saddletree design containing a conventional stirrup bar.

Referring to the drawings an initially to FIG. 1, there is illustrated a known type of saddletree. The saddletree forms the rigid internal frame for a saddle, and can be made out of fibreglass, wood, or any other suitable material. The saddletree 10 has a rear cantle portion 11, a front gullet portion 12, and a pair of side rails 13, 14 all of which are formed integrally. Rigidly attached to the saddletree is a stirrup bar 15 of known design. This stirrup bar is used for an Australian saddle and allows the stirrup leather to be removed from the stirrup bar. The stirrup bar 15 has a lower elongate finger 16 over which the stirrup leather can be supported. Typically, stitching or otherwise attaching a leather and padded overlay to the saddletree forms the saddle.

Figure 2:
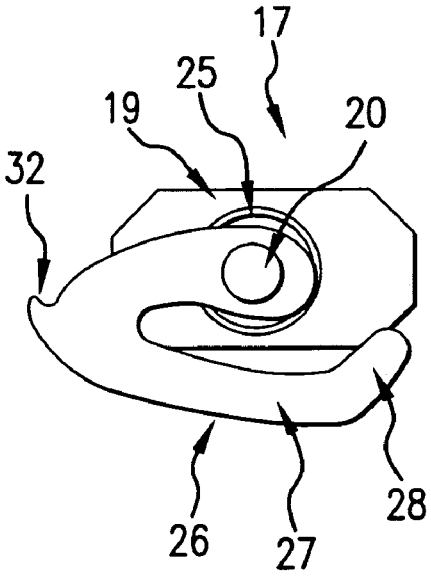
FIG. 2 illustrates a side view of a stirrup bar according to an embodiment of the invention for attachment to one side of the saddletree.
Figure 3:
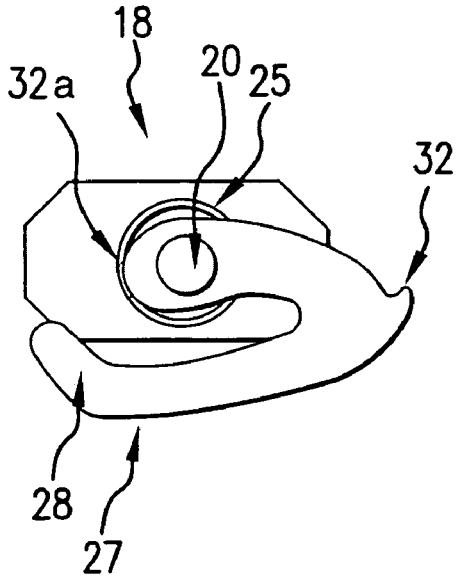
FIG. 3 illustrates the mirror image of the stirrup bar of FIG. 2 for attachment to the other side of the saddletree.

Referring to FIGS. 2 and 3, there is illustrated a left hand side and a right hand side stirrup bar assembly 17, 18 according to an embodiment of the invention. Each assembly is attached to one side of the saddletree such that the saddletree is provided with two such assemblies. In the embodiment, each assembly is provided with an attachment plate or backing plate 19. Plate 19 is fastened to the saddletree 10 by any suitable manner. Plate 19 is formed of steel and is substantially rectangular when viewed in plan except with the inclusion of bevelled corners. Plate 19 has a length of 10 cm, a width of 5 cm, and a thickness of 4 mm. This can of course vary to suit.

Figure 4:
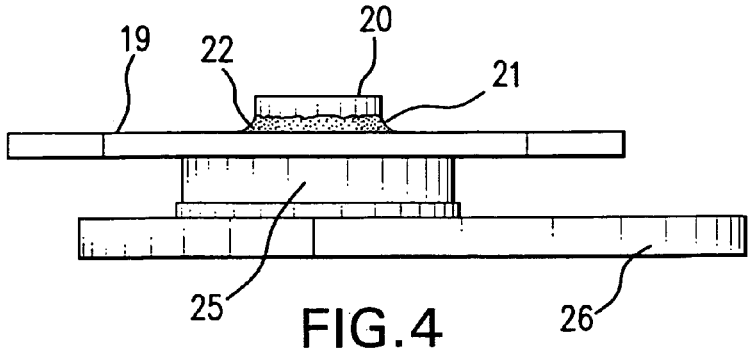
FIG. 4 illustrates an end of view of the stirrup bar of FIG. 2.
Figure 5:
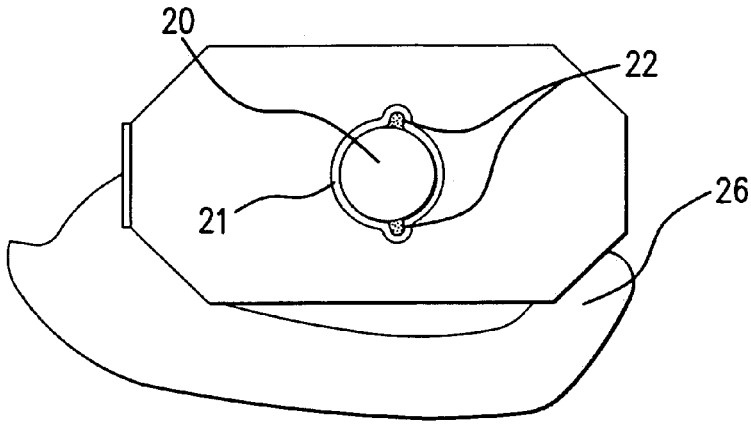
FIG. 5 illustrates a rear side view of the stirrup bar of FIG. 2.
Figure 6:
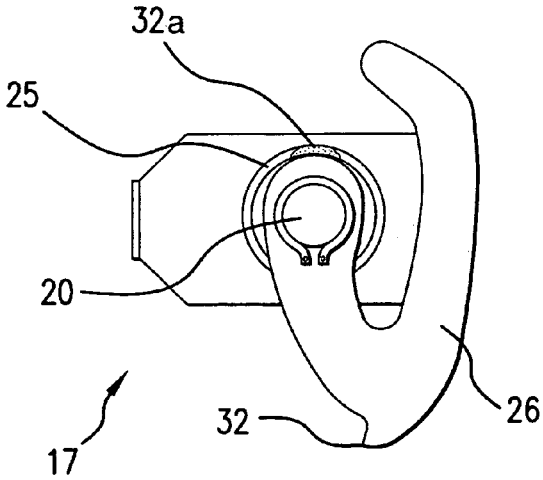
FIG. 6 illustrates how the stirrup bar can adopt a first angular position.
Figure 7:
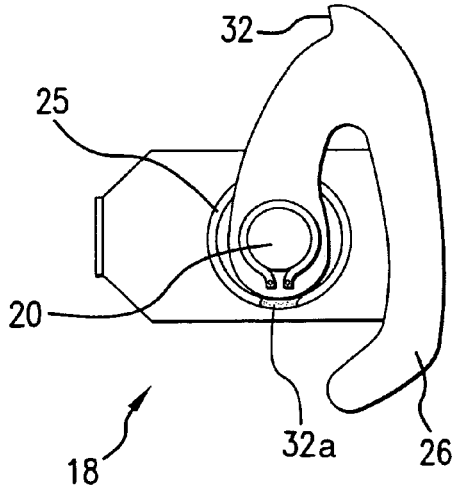
FIG. 7 illustrates how the stirrup bar can adopt a second angular position.

Attached to plate 19 is a cylindrical steel shaft 20. To fit steel shaft 20 to plate 19, plate 19 is formed with a circular hole through which steel shaft 20 passes. One end of steel shaft 20 is welded to or otherwise fixed to the rear of plate 19 such as through welds 22 (see FIG. 4 and FIG. 5). Thus, shaft 20 is rigidly attached to plate 19. The shaft 20 has a length of 25 mm, and a diameter of 20 mm.

A bearing 25 in the form of a roller bearing is press fitted over shaft 20. Thrust washers (not illustrated) are positioned on each side face of bearing 25. Bearing 25 has a diameter of 40 mm and a thickness or height of 10 mm. Bearing 25 therefore rotates about rigid shaft 20.

Figure 8:
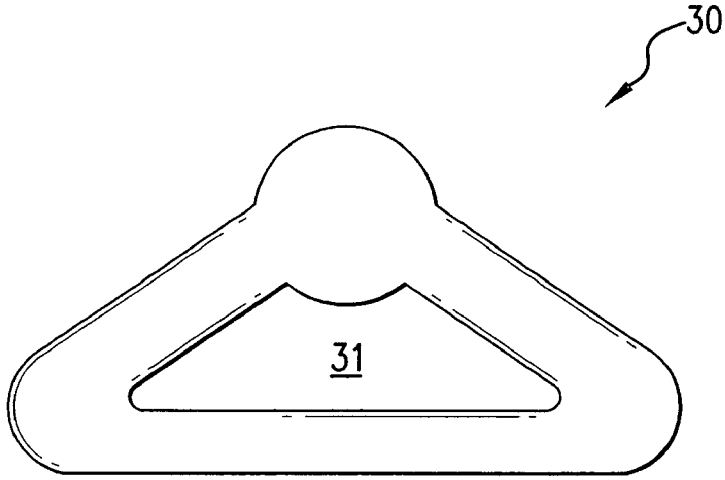
FIG. 8 illustrates a different type of stirrup bar that is particularly suitable for an American western saddle.

Attached to bearing 25 is a stirrup bar 26. The stirrup bar 26 as illustrated in FIGS. 1-7 is typical for an Australian saddle and contains an elongate lower finger 27 that has a free end 28 to allow stirrup leather to be removably attached to finger 27. FIG. 8 illustrates a different type of stirrup bar 30, i.e. closed loop, which is suited for an American western style saddle and which has a triangular type shape defining an internal opening 31 through which the stirrup leather can pass.

Figure 9:
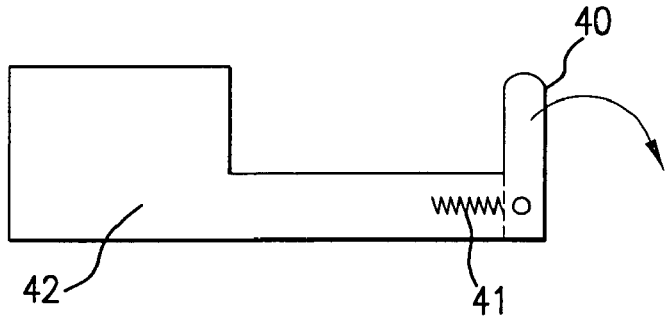
FIG. 9 illustrates another type of stirrup bar (English style stirrup bar), which has a spring mounted end piece that provides a safety feature.

It should also be appreciated that the precise shape and configuration of the stirrup bar need not be essential to the invention provided that the stirrup bar is able to rotate. Therefore, a variation of the invention would include a stirrup bar as illustrated in FIG. 1 which shows a pair of fingers which allows the stirrup bar to be a "dual position in line stirrup bar". Similarly, other types of stirrup bars can be used and these may include the American-style stirrup bar illustrated in FIG. 8, and an English style stirrup bar illustrated in FIG. 9, where the bar 42 has an end portion 40 which is spring-loaded 41 the main portion of the stirrup bar and therefore the end portion 40 is able to flip down from the position illustrated in FIG. 9 to a flipped down position where the end portion is substantially in line.

Stirrup bar 26 is welded or otherwise attached to bearing 25 by a spot weld 32*a*. Thus, stirrup bar 26 rotates with bearing 25.

Stirrup bar 26 is formed with an abutment or shoulder portion 32. A pin or other type of projection (not illustrated) is provided on saddletree 10 in such a way that the pin will abut portion 32, to prevent further rotation of stirrup bar 26. Thus, although stirrup bar 26 is theoretically able to rotate by 360° relative to plate 17, in practice, once the assembly is attached to a saddletree, a pin or projection on the saddletree will prevent such further rotation. In FIG. 1, the position of such a pin 33 is given.

Figure 10:
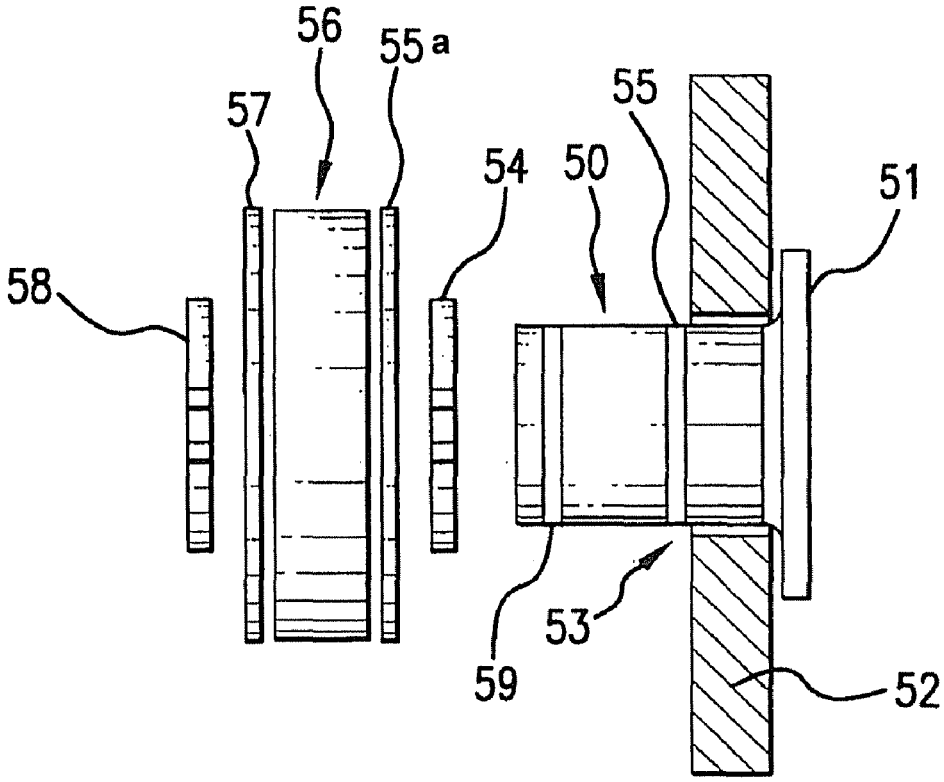
FIG. 10 illustrates a further embodiment of the invention where an attachment plate is not required and the shaft has a laterally extending portion (such as a flange), the shaft passing through an opening in the side plate of the saddletree.

Referring to FIG. 10, there is illustrated a second embodiment of the invention. This embodiment does away with the need for an attachment plate. Instead, there is provided a cylindrical steel shaft 50 one end of which has a laterally extending portion in the form of a circular flange 51. The side rail 52 of the saddle tree is formed with an opening 53 which is large enough to allow the steel shaft to pass through the opening, but too small to allow the circular flange 51 to pass through the opening. Once shaft 50 has been pushed through the opening, it is held in place by a circlip 54 that attaches to groove 55 in shaft 50. Of course, the shaft can be removed merely by removal of circlip 54. Once the shaft has been attached via circlip 54, a thrust plate 55*a* is pushed onto shaft 50. A bearing 56 similar to that described previously is then placed onto shaft 50 followed by another thrust plate 57, and the assembly is held in place by a second circlip 58 that attaches to recess 59. Attached to bearing 56 is a stirrup bar (not illustrated) which is similar to that described above.

The advantage of this variation is that the attachment plate is not required and the assembly can be removed and no welding is necessary.

Figure 11:
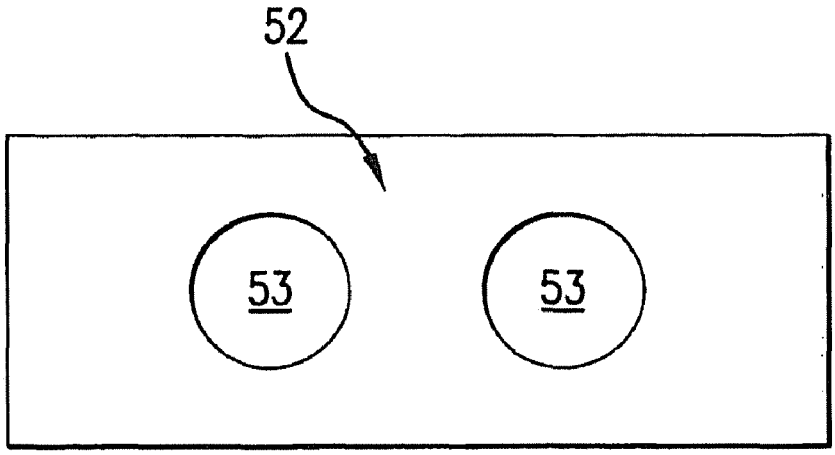
FIG. 11 illustrates a portion of the side rail of a saddletree formed with a pair of openings to provide adjustment to the positioning of the saddletree assembly.

A further advantage and variation to the invention is to form a number of openings 53 in the side rail of the saddletree. This is illustrated partially in FIG. 11. In this manner, the position of the entire assembly can be varied on the side rail of the saddle tree by choosing which opening will be used to support the shaft and therefore ultimately the stirrup bar. This allows the rider to choose the position that will be most comfortable for the rider.

The assembly allows the stirrup bar to rotate in unison with the fender strap thus transferring stress from the leather strap to the bearing 25. The stirrup bar can now rotate in any direction along with the stirrup leather.

It should be appreciated that various other changes and modifications are envisaged. For instance, there may be other means to hinge or rotate the stirrup bar relative to the saddletree. The embodiment describes a shaft 20 that is fixed to plate 19 and where the stirrup bar 26 is fixed to a bearing 25 that rotates relative to shaft 20. Of course, shaft 20 may rotate relative to plate 19 in which case stirrup bar 26 is fixed to shaft 20.

What is claimed is:

1. A stirrup bar assembly, the assembly comprising an attachment plate attached to the saddletree, a shaft attached non-rotatably to the attachment plate a stirrup bar for mounting a stirrup loop, the stirrup bar mounted for rotation on the shaft which is transverse to the length of the saddletree with the stirrup bar hanging below the shaft and the mounted stirrup loop is able to rotate both forwardly and rearwardly of the shaft while the stirrup loop is mounted to the stirrup bar, the stirrup bar comprising a closed loop for retaining the stirrup loop on the stirrup bar during rotation.

2. A saddletree containing a pair of stirrup bar assemblies, each assembly comprising a stirrup bar as claimed in claim 1.

3. The saddletree as claimed in claim 2, including a stop member to prevent over-rotation of the stirrup bar.

4. A saddle comprising a saddletree containing a pair of stirrup bar assemblies as claimed in claim 1.

5. A stirrup bar assembly, the assembly comprising an attachment plate attached to the saddletree, a shaft attached rotatably to the attachment plate, a stirrup bar for mounting a stirrup loop, the stirrup bar mounted non-rotatably to the shaft which is transverse to the length of the saddletree with the stirrup bar hanging below the shaft and the mounted stirrup loop is able to rotate both forwardly and rearwardly of the shaft while the stirrup loop is mounted to the stirrup bar, the stirrup bar comprising a closed loop for retaining the stirrup loop on the stirrup bar during rotation.

6. A saddletree containing a pair of stirrup bar assemblies, each assembly comprising a stirrup bar as claimed in claim 5.

7. The saddletree as claimed in claim 6, including a stop member to prevent over-rotation of the stirrup bar.

8. A saddle comprising a saddletree containing a pair of stirrup bar assemblies as claimed in claim 5.

* * * * *